US008292578B2

(12) United States Patent
Horiuchi et al.

(10) Patent No.: US 8,292,578 B2
(45) Date of Patent: Oct. 23, 2012

(54) MATERIAL HAVING INTERNAL COOLING PASSAGE AND METHOD FOR COOLING MATERIAL HAVING INTERNAL COOLING PASSAGE

(75) Inventors: Yasuhiro Horiuchi, Hitachinaka (JP); Nobuaki Kizuka, Hitachinaka (JP); Shinya Marushima, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 914 days.

(21) Appl. No.: 11/624,432

(22) Filed: Jan. 18, 2007

(65) Prior Publication Data

US 2007/0183893 A1 Aug. 9, 2007

(30) Foreign Application Priority Data

Feb. 9, 2006 (JP) ..... 2006-031807

(51) Int. Cl.
*F01D 5/18* (2006.01)

(52) U.S. Cl. ..... 416/1; 416/96 R; 416/97 R

(58) Field of Classification Search ..... 415/1, 115, 415/116; 416/1, 96 R, 96 A, 97 R; 165/109.1
See application file for complete search history.

(56) References Cited

U.S. PATENT DOCUMENTS

| | | | | |
|---|---|---|---|---|
| 5,395,212 | A * | 3/1995 | Anzai et al. | 416/97 R |
| 5,472,316 | A | 12/1995 | Taslim et al. | |
| 5,797,726 | A * | 8/1998 | Lee | 416/96 R |
| 5,971,708 | A * | 10/1999 | Lee | 416/97 R |
| 6,227,804 | B1 * | 5/2001 | Koga et al. | 416/96 R |
| 7,094,031 | B2 * | 8/2006 | Lee et al. | 416/97 R |
| 2006/0239820 | A1 | 10/2006 | Kizuka et al. | |

FOREIGN PATENT DOCUMENTS

| | | | |
|---|---|---|---|
| DE | 195 26 917 | | 1/1997 |
| EP | 939 196 | | 9/1999 |
| JP | 3006174 | | 1/1993 |
| JP | 05-312002 | A1 | 11/1993 |
| JP | 07-019003 | | 1/1995 |
| JP | 2000-282804 | A1 | 10/2000 |
| JP | 2001-173403 | | 6/2001 |
| JP | 2002-129903 | A | 5/2002 |

* cited by examiner

*Primary Examiner* — Christopher Verdier
(74) *Attorney, Agent, or Firm* — Mattingly & Malur, PC

(57) ABSTRACT

A material having an internal cooling passage is provided which reduces a recirculation area to perform effective cooling. In the internal cooling passage formed in the material there is a wall surface provided with cooling ribs thereon to allow a cooling medium to flow along the wall surface, and the cooling ribs are arranged so that a portion of the cooling medium flowing in the vicinity of the center of the wall surface included in the cooling passage is allowed to flow toward both side edges of the wall surface and so that a portion of the cooling medium flowing on a surface of the cooling ribs moves to conform to the surface of the cooling ribs and flows to the wall surface.

3 Claims, 10 Drawing Sheets

MATERIAL HAVING INTERNAL COOLING PASSAGE AND METHOD FOR COOLING MATERIAL HAVING INTERNAL COOLING PASSAGE

BACKGROUND OF THE INVENTION

1. Field of the Invention

The present invention relates generally to a material having an internal cooling passage and a method for cooling a material having an internal cooling passage. More particularly, the invention relates to a material having an internal cooling passage with a wall surface which includes cooling ribs.

2. Description of the Related Art

A material provided with an internal cooling passage has been described in Japanese Patent No. 3006174 (U.S. patent application Ser. No. 08/255,882). In this description, cooling ribs inclined relative to the flowing direction of a cooling medium are provided to cause the cooling medium to flow along the wall surface of the cooling passage to promote the occurrence of a turbulent flow and a flow from the center of a wall surface to a side edge thereof.

The cooling passage with the ribs disclosed by Japanese Patent No. 3006174 has a large recirculation area, which does not relatively contribute to heat transmission, at a position downstream of a rib in the flow direction of the cooling medium. The recirculation area lowers the thermal transfer performance of the entire cooling passage.

SUMMARY OF THE INVENTION

An object of the present invention is to provide a material having an internal cooling passage that creates a flow effective in cooling the material to reduce a recirculation area, thereby providing effective cooling with a small amount of the cooling medium.

To achieve the above object, according to the present invention, there is provided a material having an internal cooling passage formed therein which has a wall surface provided with cooling ribs thereon to allow a cooling medium to flow along the wall surface, wherein the cooling ribs are arranged so that a portion of the cooling medium flowing in the vicinity of the center of the wall surface included in the cooling passage is allowed to flow toward both side edges of the wall surface and so that a portion of the cooling medium flowing on a surface of the cooling rib moves to conform with the surface of the cooling rib and flows to the wall surface.

The present invention offers an effect that the flow of the cooling medium in the internal cooling passage of the material is caused to generate an effective turbulent flow, which provides a high cooling heat transfer coefficient, thereby efficiently cooling the material with a small amount of the cooling medium.

Figure 1:
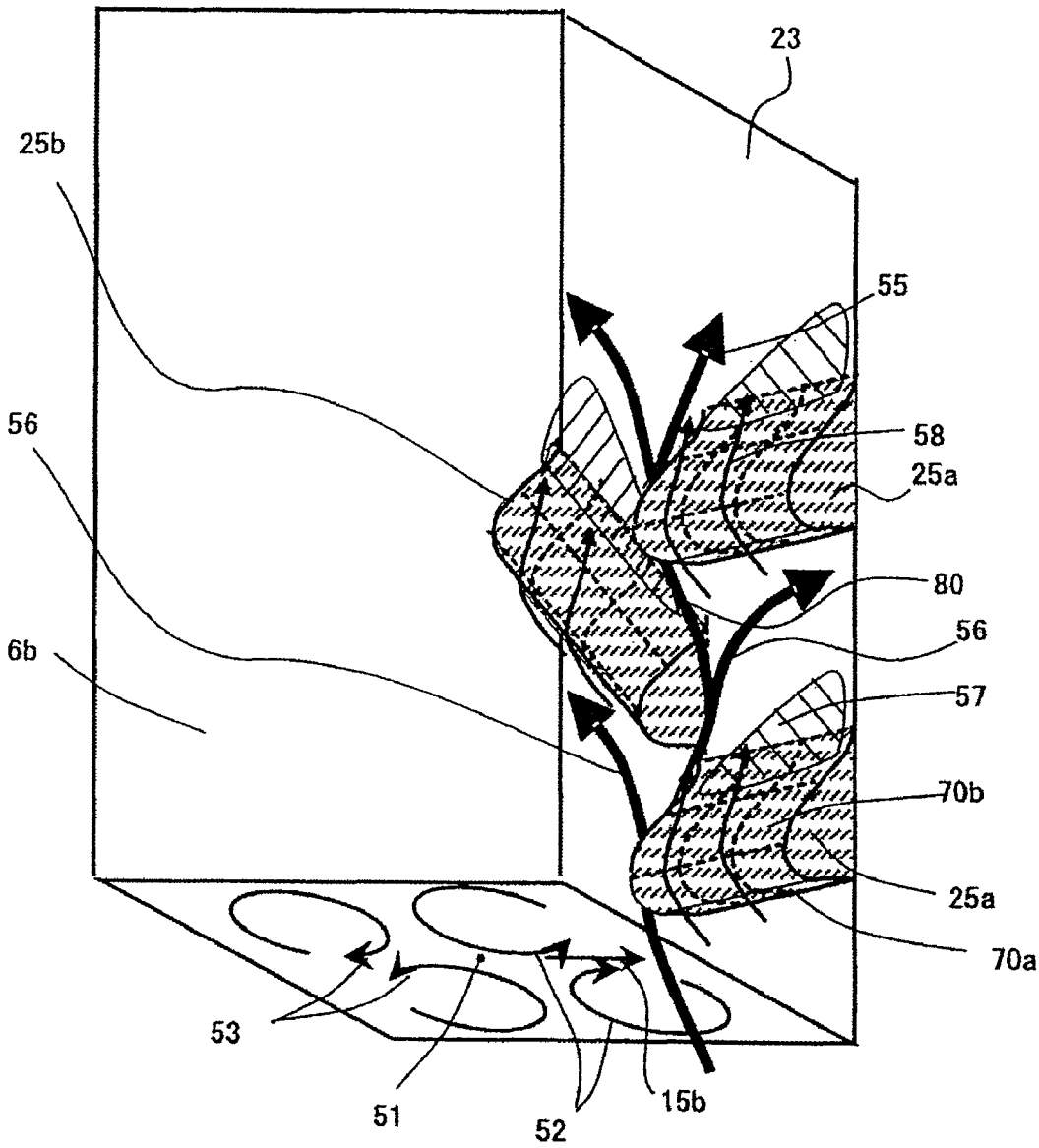
FIG. 1 is a perspective view of a cooling structure according to a first embodiment of the present invention.

Reference numerals are briefly explained as below.

1 . . . gas turbine blade, 2 . . . shank portion, 3 . . . blade portion, 4, 5 . . . passage, 6 . . . material, 6*a*, 6*b*, 6*c*, 6*d*, 6*e* . . . partition wall, 7*a*, 7*b*, 7*c*, 7*d*, 7*e*, 7*f* . . . cooling passage, 8*a*, 8*b* . . . leading end bending portion, 9*a*, 9*b* . . . lower end bending portion, 10 . . . leading end wall, 11 . . . blowout hole, 12 . . . blade rear edge, 13 . . . blowout portion, 14 . . . supplied portion, 15 . . . flow direction of cooling air, 15*b* . . . air, 20 . . . blade suction side wall 21 . . . blade pressure side wall, 23, 24 . . . rib mounting surface, 25*a*, 25*b*, 26*a*, 26*b*, 30*a*, 30*b*, 31*a*, 32*b*, 60*a*, 60*b* . . . rib, 51 . . . passage center, 52, 53 . . . secondary flow, 55 . . . snaking flow, 56, 58 . . . flow, 57 . . . recirculation area, 66 . . . corner, 70*a*, 71*a* . . . rib front surface, 70*b*, 71*b* . . . rib back surface, 80 . . . rib opening portion.

DESCRIPTION OF THE PREFERRED EMBODIMENTS

A description will be exemplarily made of a gas turbine blade which is an example of a material having an internal cooling passage.

Gas turbine installation is such that fuel and air compressed by a compressor are burned in a mixed state by a combuster to obtain a high temperature, high pressure working gas, which drives a turbine, thereby providing converted energy such as electric power.

The working gas temperature of a gas turbine is limited by the performance of a turbine blade material resistible to thermal stress resulting from the working gas temperature. To meet the allowable temperature of a turbine blade, the turbine blade is provided with a hollow portion, namely, a cooling passage, and a cooling medium such as air or steam is allowed to flow in the passage to cool the blade. Specifically, one or more passages are formed inside the turbine blade and a cooling medium is allowed to pass through the passages to cool the turbine blade from inside. There is another method in which a cooling medium is discharged to the outside of a turbine blade from a cooling hole formed in a surface of the turbine blade or at a leading edge or trailing edge thereof, thereby cooling the turbine blade.

The present embodiment is described using air as a cooling medium. Part of the air extracted from the mid stage or outlet of a compressor is used as the cooling medium. In this case, a large amount of cooling air is consumed to reduce combustion air, leading to reduced power of a gas turbine. There is also a cooling system called an open cycle in which the cooling air after cooling is discharged into a mainstream gas. In the gas turbine applying such a cooling system, an increased amount of cooling air causes the decreasing temperature of a main stream gas, resulting in the reduced thermal efficiency of the gas turbine. Thus, there is a need for efficient cooling with a lesser amount of cooling air.

It is desirable for the gas turbine to provide electric power energy with respect to consumed fuel with as much efficiency as possible. From this point, it is expected to improve the efficiency of the gas turbine. Increased temperature of the working gas is advanced as one means. On the other hand, the combined plant with a steam system using the exhaust gas of a gas turbine is largely expected to improve the total energy conversion efficiency for both a gas turbine and a steam turbine. Increased temperature of the gas turbine working gas is significantly effective in improving this efficiency. To realize the gas turbine using the higher temperature working gas, it is effective to improve the heat transfer performance of the inside of a blade, thereby improving a cooling effect, namely, cooling efficiency relative to an amount of supply cooling air. For this reason, a cooling surface is subjected to a variety of heat transfer promotion measures.

Heat transfer in the internal passage of a blade is promoted by a method in which an air flow on the heat transfer surface is caused to generate an effective turbulent flow to suppress the development of a boundary layer. In this case, it is effective to provide a large number of projections on the cooled surface in the blade inside. For example, there is a method of improving heat transfer by arranging cooling ribs left and right alternately and inclining downwardly, that is, in a staggered array with respect to a flow direction of cooling air.

Figure 9:
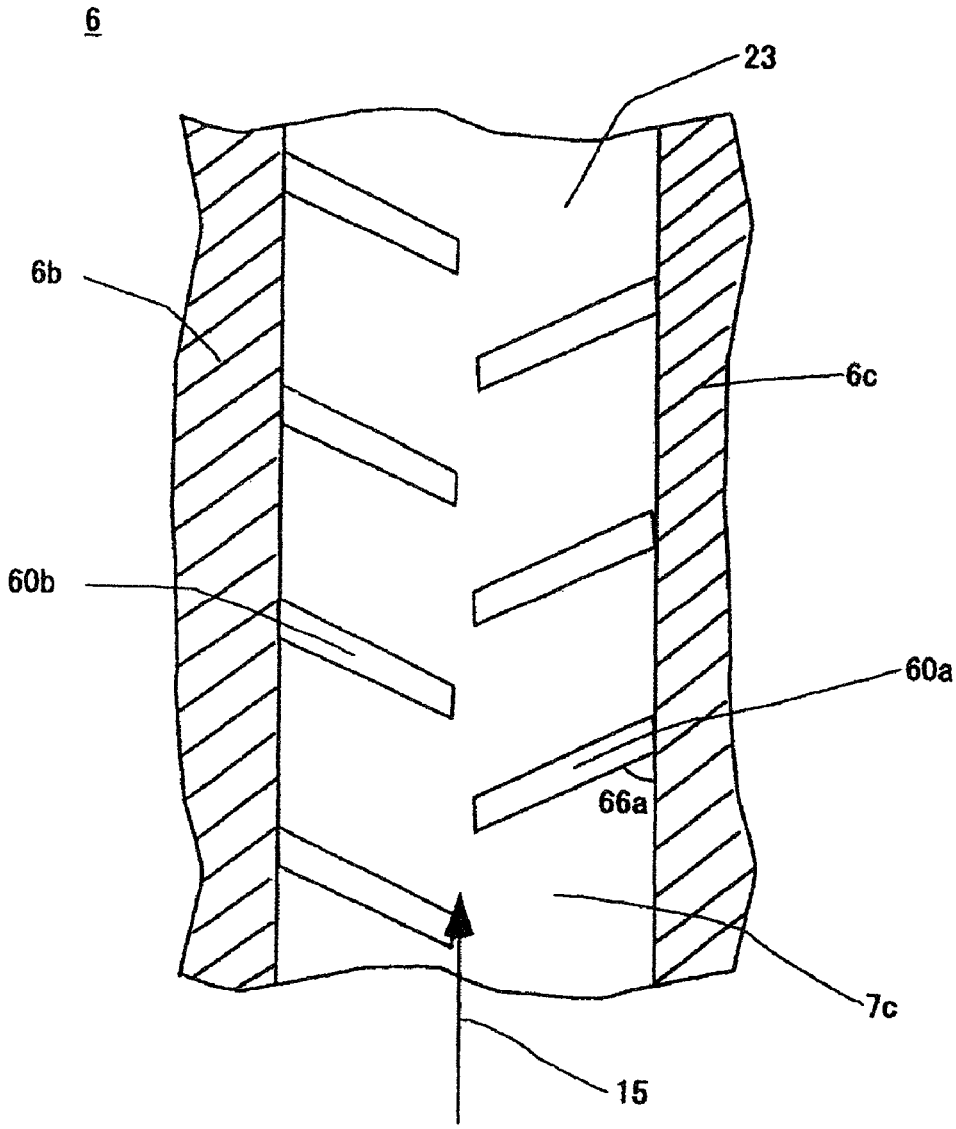
PRIOR ART FIG.9
FIG. 9 is an enlarged cross sectional view of a cooling structure according to a comparative example.

FIG. 9 illustrates a cooling passage having cooling ribs by way of example. Cooling ribs 60*a*, 60*b* are provided on the wall surface or rib mounting surface 23 of an internal cooling passage 7*c* of a material 6 having an internal cooling passage so as to be inclined with respect to a flow direction of cooling air 15. In the present specification, a cooling rib that has an angle 66 greater than 0° and smaller than 90° formed between the front surface of a cooling rib and a partition wall is called a slantly arranged cooling rib. Incidentally, the front surface of the cooling rib is an upstream side surface of the cooling rib in a flow direction of the cooling medium. In addition, the formed angle 66 is an upstream side angle in the flow direction of the cooling medium among angles formed between the front surface of the cooling rib and the partition wall on a plane parallel to the rib mounting surface. For example, if an angle 66*a* formed between the front surface of the cooling rib 60*a* and the partition wall 6*c* is greater than 0° and smaller than 90°, it can be said that the cooling rib 60*a* is inclined.

Figure 10:
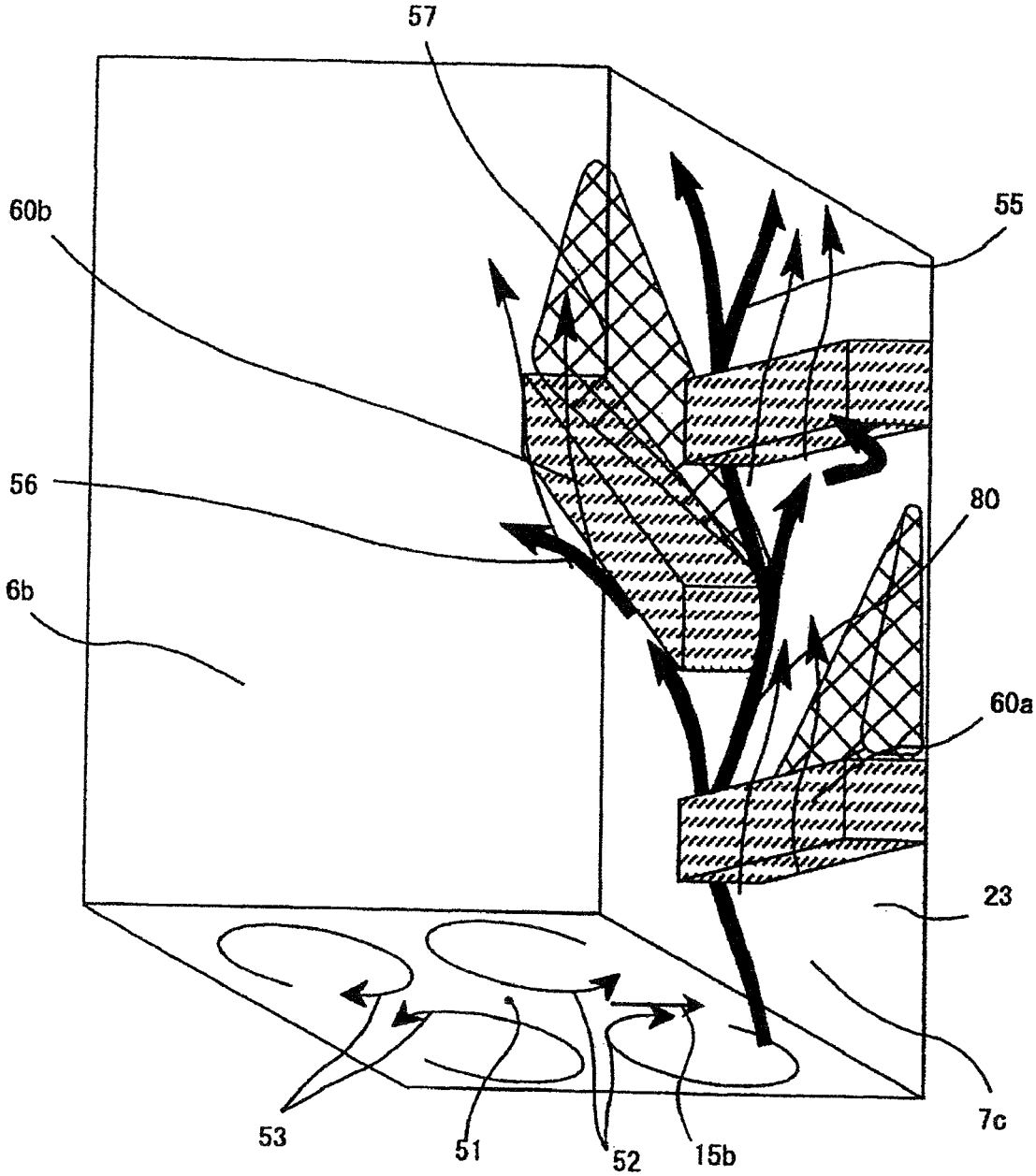
PRIOR ART FIG. 10
FIG. 10 is a perspective view of the cooling structure according to the comparative example.

FIG. 10 illustrates flows of a cooling medium around cooling ribs 60*a*, 60*b*. For simplification, a cooling passage 7*c* is generally formed like a column surrounded by four surfaces. Two pairs of secondary flows 52 and 53 are generated to be apart from the rib mounting surface 23 in the vicinity of the partition wall 6*b* which is a side wall, and to be directed to the rib mounting surface 23 in the vicinity of the passage center 51 of the cooling medium. The passage center 51 of the cooling medium indicates points on a line connecting the central points of cross sections, in the cooling passage, vertical to the flow direction of the cooling medium. A snaking flow 55 which runs in a rib opening portion 80 which is a gap between ribs and a flow 56 which is directed along the rib to the partition wall 6*b* which is the side wall are generated in the vicinity of the rib mounting surface 23. However, a relatively large recirculation area 57 which does not contribute to heat transfer exists behind the rib, which lowers the heat transfer performance of the entire passage.

Incidentally, an object of the inclined cooling ribs is to direct part of the snaking flow 55 of the cooling medium to the side wall of the cooling passage using the rib. The flow 56 directed to the side edge of the rib mounting surface is an effective turbulent flow, contributing to an improvement in cooling efficiency. As long as the above object can be achieved, therefore, the front surface of the inclined cooling rib is not necessarily flat. Part of or all of the front surface of the cooling rib may be a curved surface, a concaved surface or a convex surface. Further, the front surface of the cooling rib may be formed of a plurality of faces. If the cooling rib has a surface capable of providing an effect of promoting the flow 56, the cooling rib can provide the same kind of effect as that of the cooling rib inclined described above. In addition, cooling ribs may partially have an angle of 90° or more formed between the front surface of the cooling rib and the partition wall. In this case, if the cooling ribs are present locally, they can provide the same kind of effect as that of the cooling rib inclined described above. For this reason, in the present specification, the cooling rib inclined represents not only the cooling rib having an angle 66 greater than 0° and smaller than 90° formed between the front surface of the cooling rib and the partition wall but also every cooling rib capable of providing an effect of promoting the flow 56.

In each of the embodiments of the present invention, cooling ribs are arranged so that a cooling medium flowing on the surface of the cooling rib moves to conform to the surface of the cooling rib and then flows to a rib mounting surface. Alternatively or additionally, cooling ribs are arranged so that the distance between separation of cooling air from a cooling rib and re-attachment of the cooling air to the rib mounting surface may be reduced. The re-attachment represents that a medium that has separated from a rib again flows to conform to the rib or a rib mounting surface. The recirculation area can be reduced by concurrently performing the arrangement of cooling ribs as described above and allowing a portion of the cooling medium flowing near the center of the rib mounting surface to flow to both side edges of the rib mounting surface. This can provide a high cooling heat transfer coefficient, which makes it possible to efficiently cool a material with a small amount of the cooling medium. Incidentally, the side edge of the rib mounting surface means an edge, close to a partition wall, on a wall surface mounted with ribs thereon.

Figure 2:
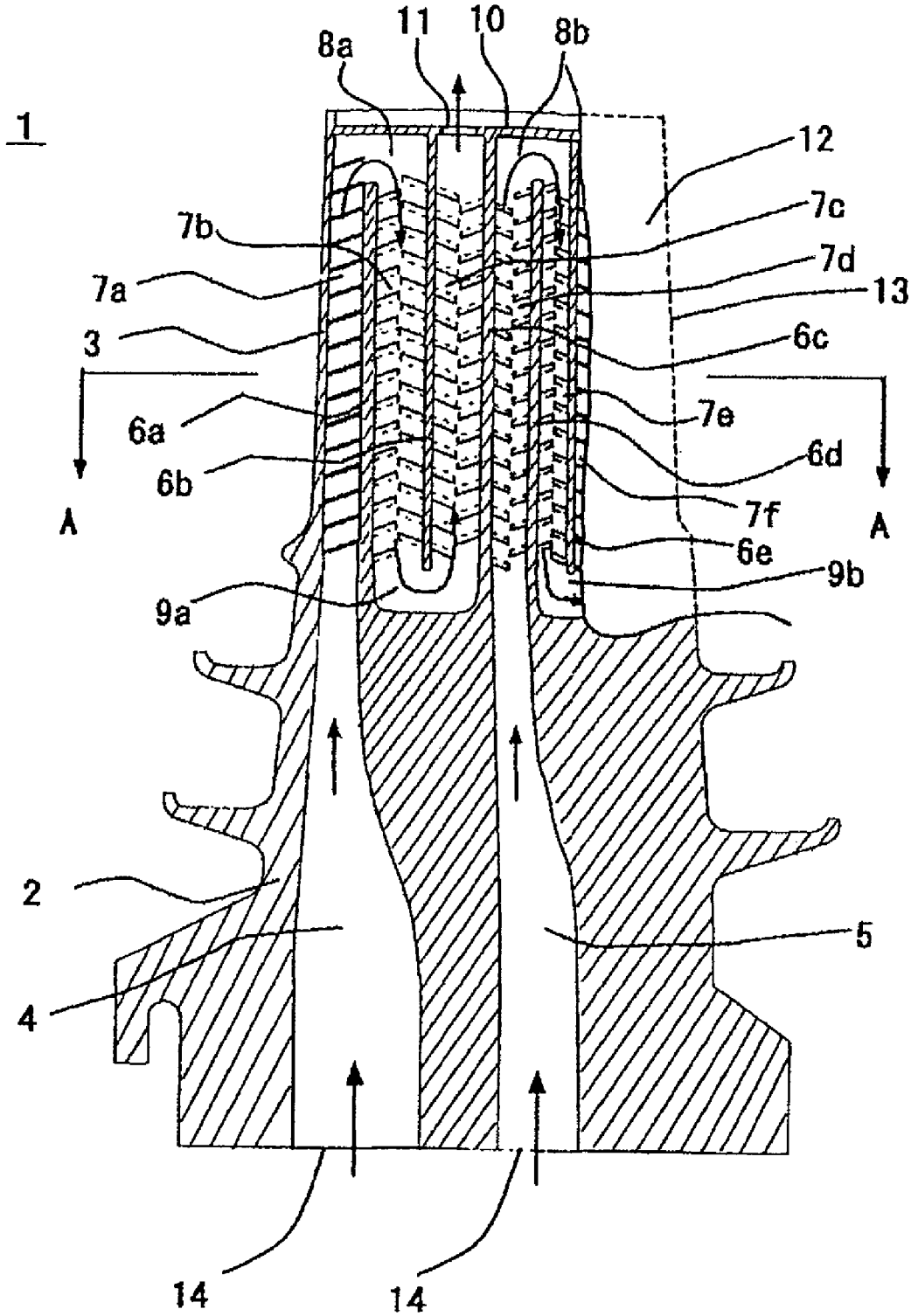
FIG. 2 is a longitudinal cross sectional view of a gas turbine blade according to a first embodiment of the invention.

A first embodiment of the present invention will be specifically described with reference to FIG. 2. FIG. 2 illustrates the cross sectional structure of a gas turbine blade embodying the present invention.

In a gas turbine blade 1 depicted in FIG. 2, internal passages 4, 5 are provided inside a shank portion 2 and a blade portion 3. In the blade portion 3, the internal passages 4, 5 are divided into cooling passages 7*a*, 7*b*, 7*c*, 7*d*, 7*e*, 7*f* by partition walls 6*a*, 6*b*, 6*c*, 6*d*, 6*e*. The internal passages 4, 5 forms serpentine passages together with leading end bending portions 8*a*, 8*b* and lower bending portions 9*a*, 9*b*. In other words, in the embodiment, the first passage 4 is a serpentine cooling passage which includes the cooling passage 7*a*, the leading end bending portion 8*a*, the cooling passage 7*b*, the lower bending portion 9*a*, the cooling passage 7*c* and a blowout hole 11. The internal passage 5, a second passage, is a serpentine cooling passage which includes the cooling passage 7*d*, the leading end bending portion 8*b*, the cooling passage 7*e*, the lower bending portion 9*b*, the cooling passage 7*f* and a blowout portion 13 provided in the blade rear edge 12.

Air as a cooling medium is supplied from a rotor disk holding the turbine blade 1 to a supplied portion 14. The air cools the blade from inside while passing through the passages 4, 5 which are serpentine cooling passages. The air that has absorbed heat from the blade is blown out into working gas from the blowout hole 11 provided in a blade leading end wall 10 and the blowout portion 13 of the blade rear edge 12.

Cooling ribs applied to promote a turbulent flow are inclined on the cooling wall surfaces of the cooling passages 7*b*, 7*c*, 7*d*, 7*e*. This arrangement generates effective turbulent flows to promote heat transfer, thereby enhancing a blade cooling effect.

Figure 3:
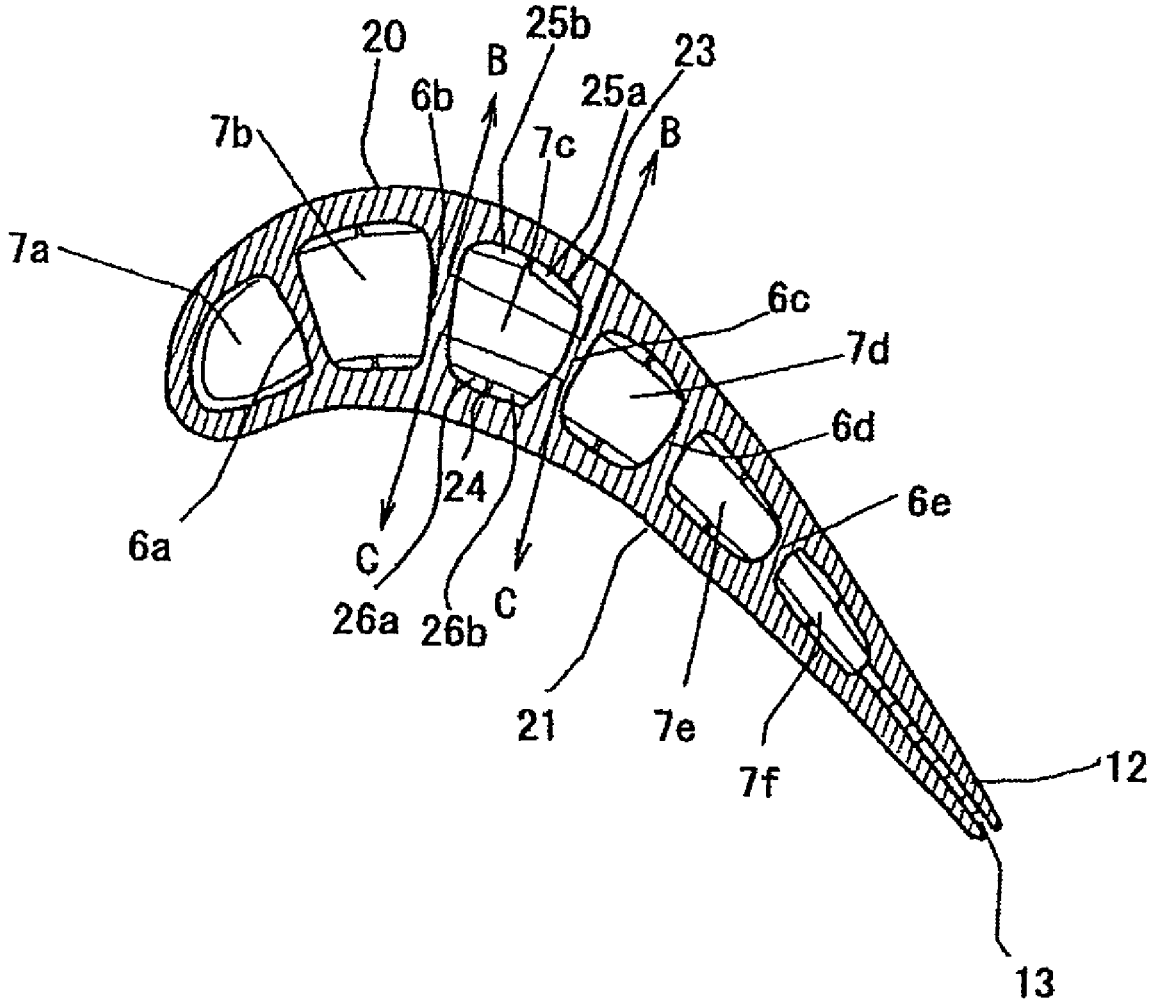
FIG. 3 is a transverse cross sectional view of the gas turbine blade according to the first embodiment taken along line A A of FIG. 2.

FIG. 3 illustrates a cross section of the turbine blade 1 taken along line "A-A" of FIG. 2. In FIG. 3, reference numerals 20 and 21 denote a blade suction side wall and a blade pressure side wall, respectively, which constitute the blade portion of the turbine blade 1. The cooling passages 7*a*, 7*b*, 7*c*, 7*d*, 7*e*, 7*f* are defined by the blade suction side wall 20, the blade pressure side wall 21, and the partition walls 6*a*, 6*b*, 6*c*, 6*d*, 6*e*. For instance, the cooling passage 7*c* is defined by the blade suction side wall 20, the blade pressure side wall 21 and the partition walls 6*b*, 6*c*. Cooling ribs 25*a*, 25*b* configured integrally with the blade suction side wall 20 are provided on a rib mounting surface 23, which is a back side cooling surface of the cooling passage 7*c*. In addition, cooling ribs 26*a*, 26*b* configured integrally with the blade pressure side wall 21 are provided on a rib mounting surface 24 which is a ventral side cooling surface opposite the rib mounting surface 23. Incidentally, as with the cooling passage 7*c*, also in the cooling passages 7*b*, 7*c*, 7*d*, cooling ribs applied to promote heat transfer are mounted on the ventral side cooling surface of the blade pressure side wall 21 and the back side cooling surface of the blade suction side wall 20.

Figure 4:
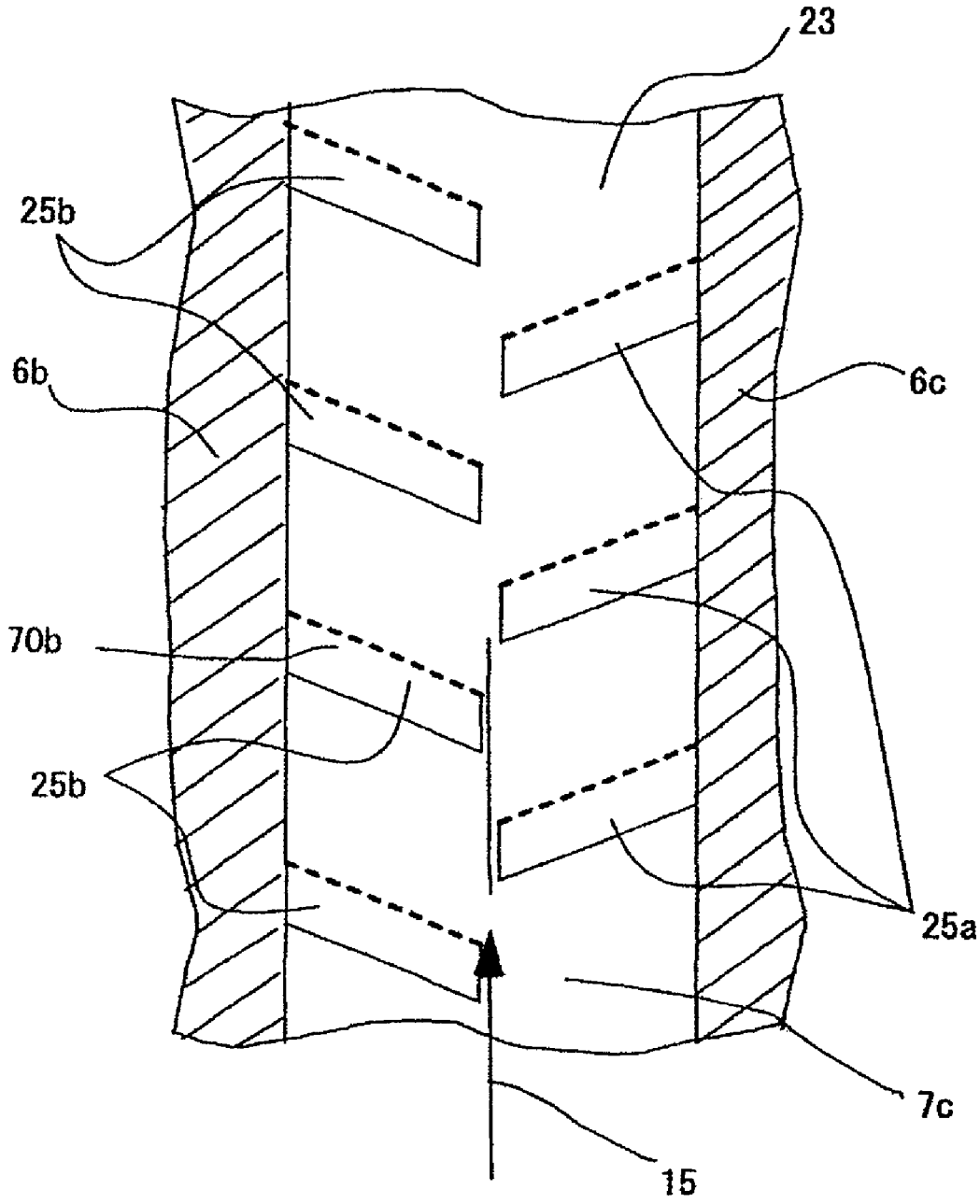
FIG. 4 is an enlarged cross sectional view according to the first embodiment of the present invention taken along line B-B of FIG. 3.

FIG. 4 illustrates a cross section of the cooling passage 7*c* taken along line "B-B" of FIG. 3. FIG. 4 is a longitudinal cross sectional view of the cooling passage. A description is made herein taking the ribs provided on the blade suction side wall 20 as an example. The cooling ribs integrally mounted to the rib mounting surface which is a back side cooling surface of the blade suction side wall 20 include pluralities of cooling ribs 25*a* and 25*b* arranged in an alternating configuration. The cooling rib 25*a* has one end, near the partition wall 6*c*, which is located on the downstream side of the other end in the flow direction of the cooling medium while extending from near the middle between the opposed partition walls 6*b*, 6*c*, to one partition wall 6*c*. The cooling rib 25*b* has one end, near the partition wall 6*b*, which is located on the downstream side of the other end in the flow direction of the cooling medium while extending from near the middle between the opposed partition walls 6*b*, 6*c*, to the other partition wall 6*b*. In other words, the cooling ribs are arranged alternating on the left and right from almost the center of the rib mounting surface 23 which is a back side cooling surface. In addition, they are inclined downwardly with respect to the flow direction of the cooling air in a staggered array. The cross section shapes of the cooling passages are almost rectangular, trapezoidal, or rhombic.

The cooling ribs 25*a* and 25*b* of the present embodiment respectively have the following cross sections at their boundaries with the partition walls 6*b* and 6*c*. A front surface with respect to a forming direction of the cooling passage provides a straight line relative to a wall surface. In addition, a line extending from the highest position of the straight line to a position, rearward of the highest position, reaching the rib mounting surface 23 is a streamline. In other words, the upper surface and back surface of the cooling rib have a streamlined shape. Incidentally, the streamlined shape means that a cross sectional shape of a rib taken along a plane vertical to a flow direction of the cooling medium has a gradient continuously extending along a curve defined by a plurality of straight lines and or functions. The front surface of the cooling rib is a portion having an effect of mainly promoting the formation of a flow 56. The back surface is a portion that is hidden behind the flow of the cooling medium on the downstream side in the flow direction of the cooling medium. The upper surface includes a surface parallel or almost parallel to the rib mounting surface and connects the front surface with the back surface. Cooling ribs do not have the upper surface depending on their shapes.

FIG. 4 illustrates the cooling passage 7*c* in which the flow of a cooling medium in FIG. 2 is an upward flow. Even in a case of the cooling passage in which the flow of a cooling medium is a downward flow as shown with symbols 7*b* and 7*d*, cooling ribs are arranged in an alternating configuration and inclined downwardly with respect to the flow of the cooling air. In addition, the upper surface and back surface of the cooling rib are each streamlined as with the cooling passage 7*c*.

Next, a description is made of the flow of cooling air around the cooling ribs 25*a*, 25*b* in the cooling passage 7*c* using FIG. 1. It is to be noted that the rib mounting surface 24 which is a wall surface opposite to the rib mounting surface 23 having the cooling ribs 25*a*, 25*b*, the cooling ribs 26*a*, 26*b* present on the rib mounting surface 24, and the partition wall 6*c* are omitted in the illustration.

In the cooling passage 7*c*, two pairs of secondary flows 52 and 53 are generated to be apart from the cooling surface in the vicinity of the partition walls 6*b* and 6*c* corresponding to the passage side walls and to be directed to the rib mounting surface in the vicinity of the passage center 51. In the vicinity of the cooling ribs 25*a*, 25*b* promoting heat transfer, a snaking flow 55 and a flow 56 are generated. The snaking flow 55 moves to conform to a rib opening portion 80 which is a portion of the rib mounting surface 23 where cooling ribs are not mounted. The flow 56 branches from the snaking flow 55 and is directed to the partition walls 6*b*, 6*c* along the ribs.

When flowing in the vicinity of the passage center 51, cooling air does not contribute to cooling the material so much. On the other hand, the cooling medium flowing near the rib mounting surface 23 which is a back side cooling surface and the rib mounting surface 24 which is a ventral side cooling surface performs thermal exchange with a high temperature material to cool it. Consequently, the cooling medium near the passage center 51 has relatively lower temperatures than the cooling medium present outside in the cooling passage 7*c*.

In the present embodiment, the cooling ribs 25*a*, 25*b* applied to promote heat transfer are arranged to generate the flow 56 that is directed from the center of the rib mounting surface 23 to the boundary with the partition walls 6*c*, 6*b* which are side edges of the rib mounting surface 23. A cooling rib that generates the similar flow is arranged on the rib mounting surface 24 which is a ventral side cooling surface. As a result, generation of the two pairs of secondary flows 52, 53 are promoted. These two pairs of secondary flows 52, 53 can circulate the low temperature cooling medium near the passage center 51 and the high temperature cooling medium near the rib mounting surfaces 23, 24. It is possible, therefore, to supply a lower temperature cooling medium to the vicinity of the rib mounting surface 23 (the back side cooling surface) and to the vicinity of the rib mounting surface 24 (the ventral side cooling surface) which need the cooling medium having a lower temperature.

For the above reason, the snaking flow 55 provides a turbulent flow structure into which the cool air 15*b* having the low temperature in the passage center 51 is brought by the secondary flows 52. This increases an effect of cooling, particularly, the central portion of the passage on the rib mounting surface 23 and further portions on the passage central side of the cooling ribs 25*a* and 25*b*.

On the other hand, there is a possibility that the recirculation areas 57 which do not contribute to heat transfer so much are formed at the rear of the cooling ribs 25*a*, 25*b* with respect to the flow direction of the cooling medium. When fluid passes over the rib, the flow of the fluid tends to separate from the rib. Therefore, the fluid is unlikely to reach a portion hidden behind the flow of the fluid, namely, an area at the rear of the rib. This area is called a recirculation area. Fluid hardly enters the recirculation area 57 from the outside thereof. Most of the fluid in the recirculation area continues to circulate. Incidentally, when fluid separates from the rib mounting area, a large pressure loss occurs.

In the present embodiment, the upper surface and back surface of the cooling rib are streamlined. Therefore, a flow 58 that includes part of the flow 56 guided by the rib to be directed to the partition wall and that is about to go over the cooling rib moves along the upper surface and back surface of the rib and then flows rearward of the rib. This makes it possible to suppress separation of the cooling medium on the rib to reduce the pressure loss of cooling air and concurrently to reduce the recirculation area 57.

The air that absorbs heat from the material to rise in temperature circulates in the recirculation area 57. Therefore, reducing the recirculation area contributes to an increase in material cooling efficiency. The low temperature air 15*b* at the passage center 51 that moves with the secondary flow 52 is supplied, as the flow 56 directed to the snaking flow 55 and the partition wall, to a portion where the circulation area is reduced compared with conventional one, thus cooling the material.

In conclusion, the present embodiment provides the effects of: reducing the recirculation area 57 by smoothing the upper surfaces and back surfaces of the cooling ribs 25*a* and 25*b*; directing the low temperature air at the passage center 51 to the snaking flow 55 by the secondary flow 52; and reducing the pressure loss of the cooling medium resulting from the separation. Such a synergystic effect can efficiently cool the gas turbine blade of the present embodiment.

The description of the cooling ribs 26*a* and 26*b* is partially omitted in the embodiment. However, needless to say, as with the heat transfer promotion ribs 25*a* and 25*b* mounted on the rib mounting surface 23 which is a back side cooling surface, the cooling ribs 26*a*, 26*b* are mounted on the rib mounting surface 24 which is a ventral side cooling surface and provide the same effects as those of the heat transfer promotion ribs 25*a*, 25*b*.

In addition, the present embodiment provides the example in which the upper surface and back surface of the rib are streamline shaped to suppress the separation of the cooling medium on the rib. However, the effect obtained by the embodiment is not limited to the streamline shape. If a rib is shaped to increase the distance where the cooling medium moves along the upper surface and back surface of the rib, as compared with the shape of the conventional rectangular rib, the same kind of effect can be provided. In addition, if the shape of the rib can reduce the degree of the separation of the cooling medium as compared with the shape of the conventional rectangular rib, the same kind of effect can be provided. The shape of a cooling rib is needed only to promote the fact that the cooling medium flowing on the surface of the cooling rib moves to conform to the surface of the rib and then flows to the rib mounting surface. Such shapes similar to the streamline shape include one in which combinations of a large number of reed shaped planes are mounted along the streamline.

Figure 5:
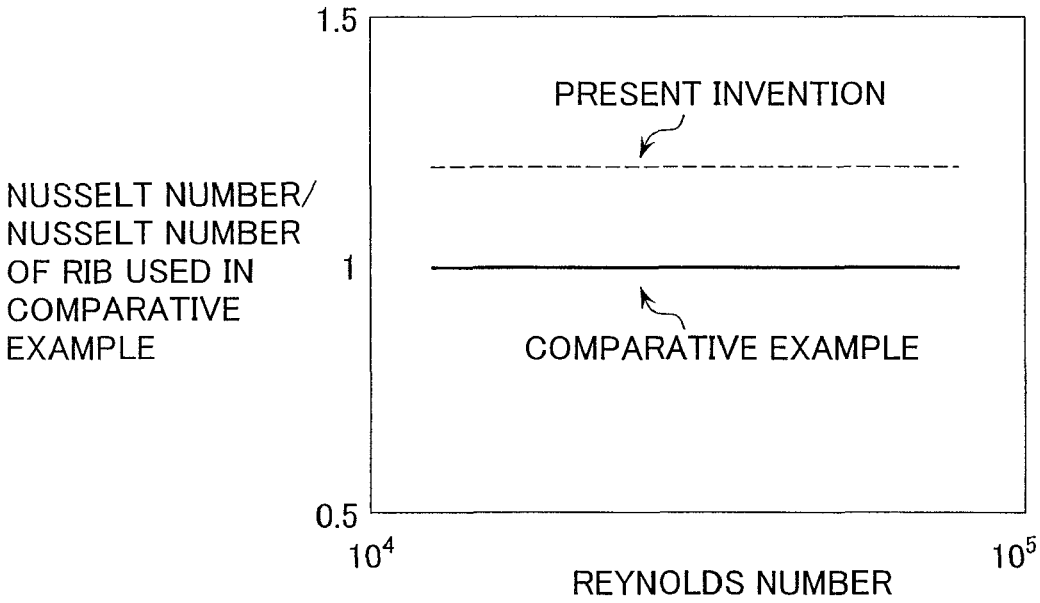
FIG. 5 is a comparative diagram illustrating comparison between the Nusselt number of the embodiment of the invention and that of a comparative example.

FIG. 5 illustrates the tendency of heat transfer characteristics in the present embodiment. In FIG. 5, the axis of ordinate indicates a ratio of a dimensionless value average Nusselt number which indicates the flow condition of heat, to a Nusselt number of the rib mounting surface using ribs of FIGS. 9 and 10 used as a comparative example. The axis of abscissa indicates a dimensionless Reynolds number which indicates the flow condition of cooling air. In this diagram, the larger the value on the axis of ordinate, the more preferable the cooling performance is. The diagram shows the tendency in which the heat transfer performance of the embodiment structure is higher than that of the comparative example.

A second embodiment of the present invention is described with reference to FIGS. 6 and 7. Portions in FIGS. 6 and 7 common to those of FIGS. 3 and 4, respectively, are denoted with the same symbols and their explanation is omitted.

Figure 6:
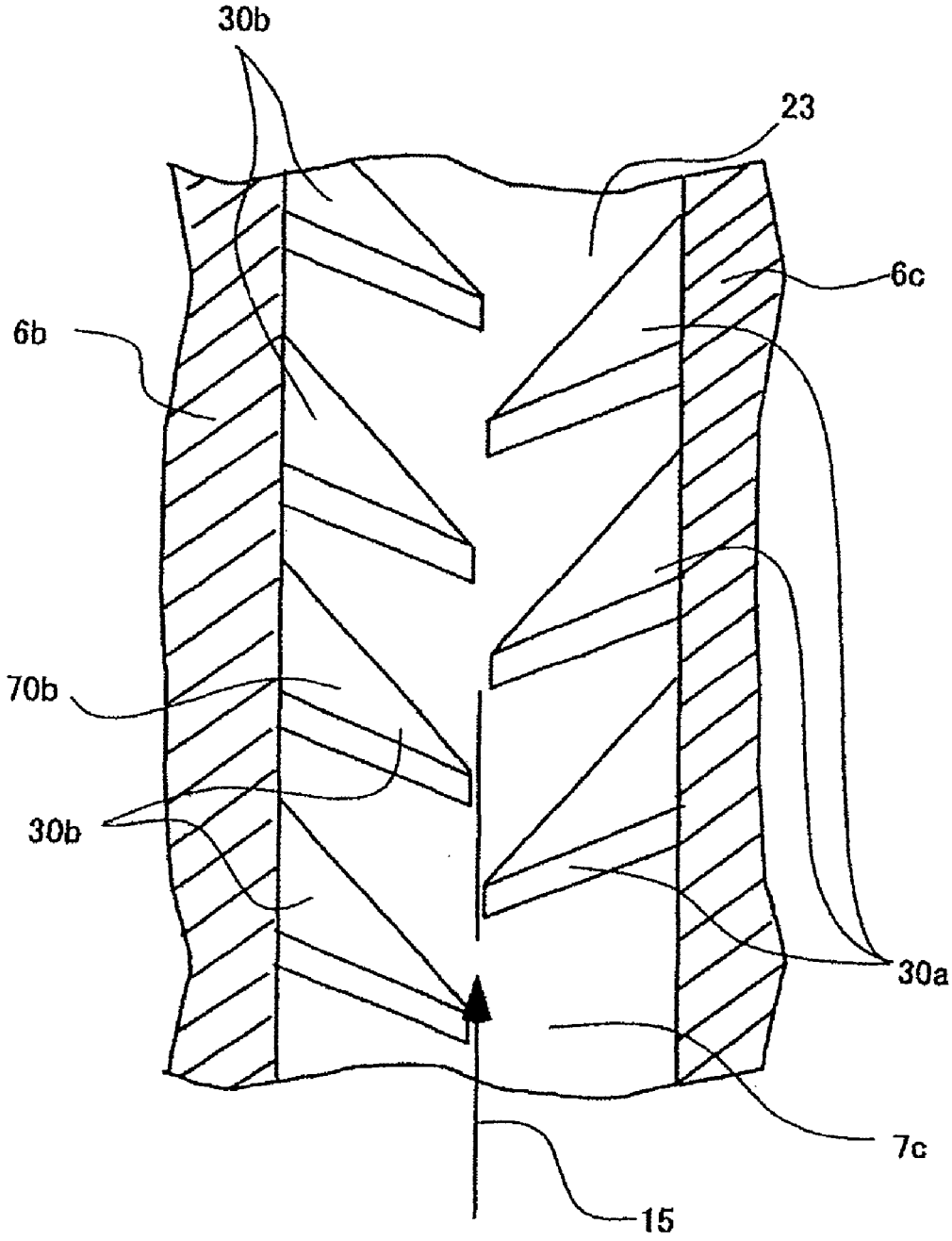
FIG. 6 is an enlarged cross sectional view of a cooling structure according to a second embodiment of the present invention.

FIG. 6 is a longitudinal cross sectional view of a cooling passage. A description is here made taking the ribs provided on the blade suction side wall 20 as an example. Heat transfer promotion ribs 30*a*, 30*b* on a rib mounting surface 23 which is a back side cooling surface are arranged alternately left and right from near an equidistance line from the boundaries with partition walls 6*b*, 6*c* which are on the rib mounting surface 23. In addition, the ribs 30*a*, 30*b* are arranged at different angles with respect to the flow direction of cooling air. In other words, the cooling ribs 30*a*, 30*b* applied to promote turbulent flow are inclined downwardly with respect to the flow of cooling air and in a staggered array. The conventional turbulent flow promotion ribs have the same sectional shape in any cross sections in the flow direction of cooling air in many cases. However, the cooling rib 30 of the present embodiment has a back surface 70*b* that gradually becomes longer in length of the flow direction as it goes from the passage center toward the partition wall 6*c* which is a side wall. In addition, the rib has a height that becomes lower as it goes toward the flow direction of cooling air and becomes zero at a position in front of the rearward partition wall 6*b*.

Figure 7:
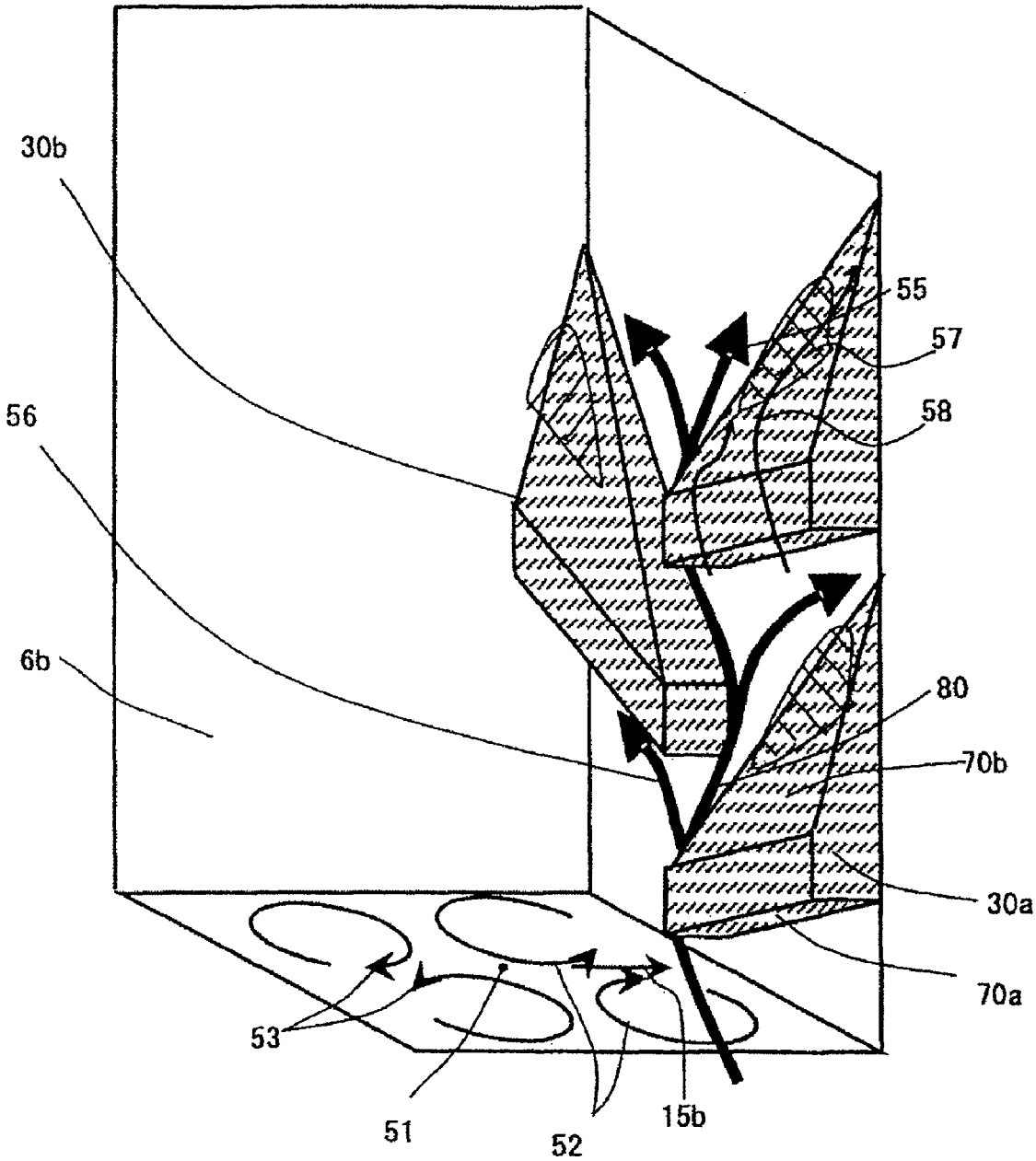
FIG. 7 is a perspective view of the cooling structure according to the second embodiment of the present invention.

FIG. 7 illustrates the behavior of flow around cooling ribs arranged in the cooling passage 7*c*. In the present embodiment, the cross section of the rib is changed in a direction perpendicular to the flow of cooling air to form an inclined plane on the back surface 70*b* of the rib which is on the downstream side of the rib. This accelerates the re-attachment, to the heat transfer surface, of a flow 58 that is part of a flow 56 moving along the rib toward the partition wall 6*b*, 6*c* and that goes over the rib. That is, the distance where the cooling air separates from the rib can be reduced. Thus, a recirculation area 57 can be reduced.

In short, the present embodiment provides an effect of reducing the recirculation area by forming each of the back surfaces of the cooling ribs 30*a*, 30*b* into a shape where the cooling air passing over the upper surface of the rib tends to re-adhere to the rib mounting surface 23 and reducing the distance to re-attachment. In addition, the embodiment provides an effect of allowing secondary flows 52 to direct low temperature air at a passage center 51 to a snaking flow 55. Such a synergetic effect can provide more efficient cooling also for the gas turbine blade of the present embodiment as compared with conventional one similarly to that of the first embodiment.

The configuration of the present embodiment is characterized in that the back surface of a rib is formed as an inclined plane to promote re-attachment of a separate cooling medium to the rib, thereby reducing the recirculation area 57. Thus, if a cooling rib is formed to promote re-attachment of a cooling medium, it may be formed differently from that of the present embodiment.

Figure 8:
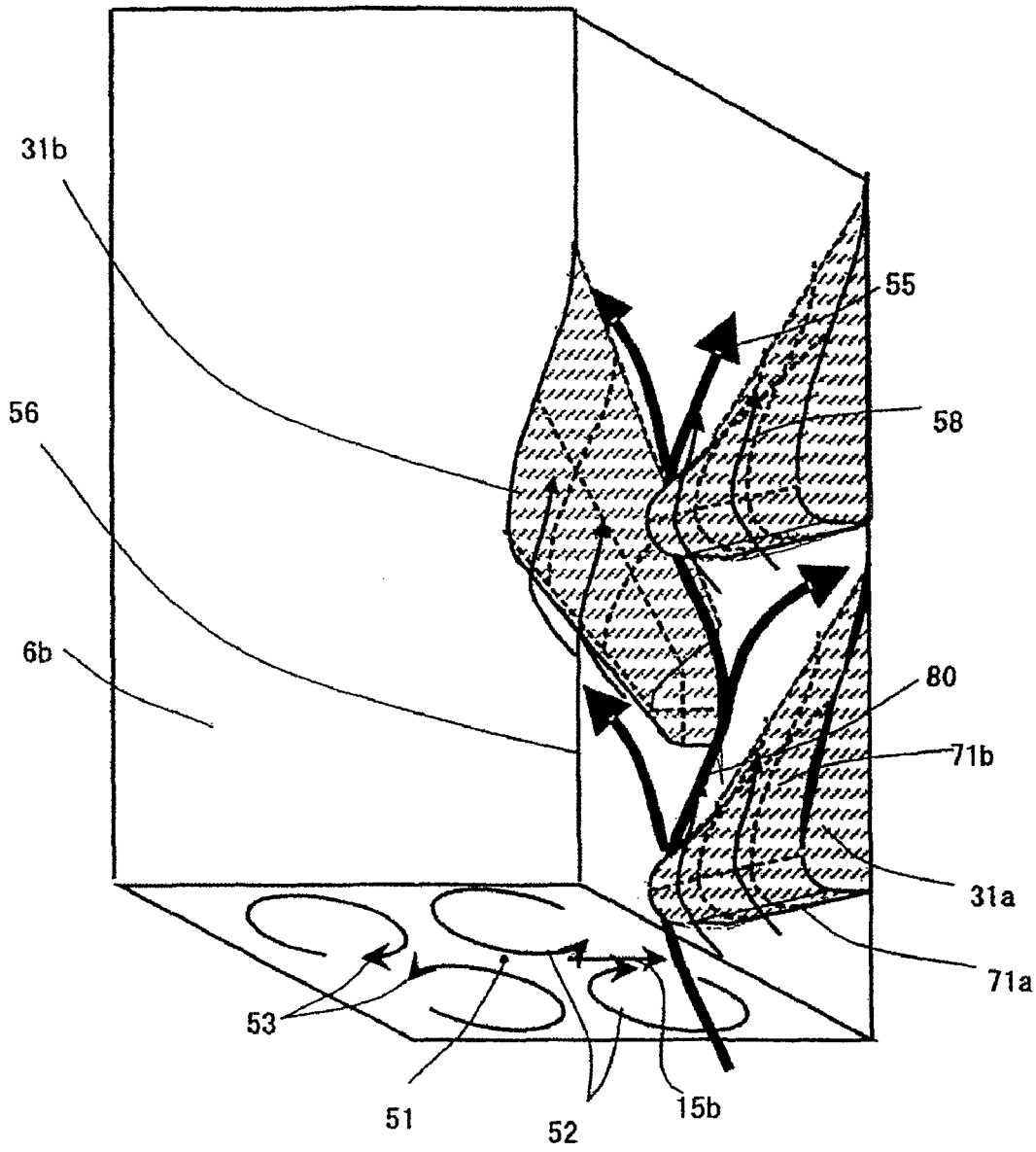
FIG. 8 is a perspective view of a cooling structure according to a third embodiment of the present invention.

FIG. 8 illustrates a third embodiment of the present invention. Similarly to FIGS. 1 and 7, FIG. 8 shows the behavior of flows around ribs in a cooling passage 7*c* in which a cooling promotion rib structure is arranged. A description is made also taking ribs mounted on the blade suction side wall 20 as an example. Cooling ribs 31*a*, 31*b* mounted on a rib mounting surface 23 are arranged alternately from near the center of the rib mounting surface 23 and at different angles with respect to the flow direction of cooling air. In other words, the cooling ribs 31*a*, 31*b* are inclined downwardly and alternately with respect to the flow. However, the cooling rib 31*a* of the present embodiment has a front surface 71*a* that is streamlined in cross section in a cooling passage forming direction. In addition, the cooling rib 31*a* has a back surface 71*b* formed as below. The length of the rib in the flow direction is progressively increased as the rib goes from the passage center to the partition wall 6*c* which is a side wall. The height of the rib is reduced as the rib goes toward the flow direction of cooling air and becomes zero in front of the rearward rib. In short, it can be said that the cooling rib of the present embodiment results from the streamlined rib of the first embodiment to which the shape of the rib in the second embodiment is applied.

The formation of the cooling promotion ribs as described above can synergize the effects of the first embodiment, namely, the effect of reducing the recirculation area by suppressing separation on the upper surface of the rib and the effect of reducing pressure loss, and the effect of the second embodiment, namely, the effect of accelerating re-attachment to reduce the re circulation area. This synergetic effect along with the configuration of allowing the secondary flow 52 to direct the low temperature air at the passage center 51 to the snaking flow 55 can further reduce or eliminate the recirculation area to provide a high heat transfer effect.

Incidentally, the cooling rib of the present embodiment is configured such that its cross section taken along a plane parallel to the surface of the partition wall is streamlined and its back surface has a moderate inclination. However, other cooling ribs may be acceptable if they are shaped to have an effect of suppressing the separation of a cooling medium on the cooling rib and to promote re-attachment of the cooling medium that has separated from the rib. This is because the cooling rib having such a shape can provide the same kind of effect as that of the present embodiment.

While each embodiment describes the basic configuration of the present invention, it is the matter of course that other various embodiments, modifications and applications can be conceivable.

The embodiments of the present invention have been described thus far. However, the number of the types of shapes of ribs is not limited to one but may be two or more for each rib mounting surface. Even if the number of the types of shapes of ribs is two or more, the same effect can be provided. The shapes of ribs are not numerically restrictive. Incidentally, the cooling rib is positionally mounted to extend from near the center of the rib mounting surface toward the side edge. However, if a cooling rib has such a length that generates a snaking flow on the rib mounting surface, it may be longer or shorter than that of the present embodiments in a direction vertical to the flow of the cooling medium.

In addition, the gas turbine blade is desired to have a uniform temperature as much as possible in terms of strength. On the other hand, the external thermal conditions of the turbine blade are different depending on the circumference of the blade. Therefore, to cool the blade to a uniform temperature, it is appropriate that the blade back side, the blade ventral side and the partition wall cooling rib structures are allowed to conform to external thermal conditions. Specifically, the structures, shapes and arrangement specifications of cooling ribs that have been shown in each of the embodiment or that can be otherwise conceivable are adopted to meet the requirements of each cooling surface.

The above description has been made taking the gas turbine as an example. As described above, the present invention is not limited to the gas turbine and can be applied to a device if the device includes a material having an internal cooling passage. While the embodiments show the return flow type structure having two internal structures, the application of the present invention does not limit the number of cooling passages. The description has been made taking the cooling medium as air. However, the cooling medium may be another medium such as steam. Incidentally, the gas turbine blade adopting the structure of the present invention is configured simply and can be manufactured also by current precision casting.

What is claimed is:

1. A material having an internal cooling passage formed therein, the cooling passage having a wall surface provided with cooling ribs thereon to allow a cooling medium to flow along the wall surface, wherein the cooling ribs include:

a plurality of first cooling ribs disposed on the wall surface of the cooling passage, each of the first cooling ribs extending toward a first side edge of the wall surface from adjacent an intermediate line which extends between the first side edge of the wall surface and a second side edge of the wall surface and in a downstream direction of a flow of the cooling medium;

a plurality of second cooling ribs disposed on the wall surface of the cooling passage, each of the second cooling ribs extending toward the second side edge of the wall surface from adjacent the intermediate line in the downstream direction of the flow of the cooling medium, wherein the plurality of the first ribs and the plurality of the second ribs are alternately arranged in the flow direction of the cooling medium, wherein the plurality of the first ribs and the plurality of the second ribs each have a cross section including a front rib surface, wherein the plurality of the first ribs and the plurality of the second ribs each have a back surface extending from the front surface and being one of streamlined in the flow direction of the cooling medium and shaped similarly to a streamline of the cooling medium in the flow direction, wherein the plurality of the first ribs and the plurality of the second ribs are arranged in a staggered array with respect to the flow direction of the cooling medium so that ones of the plurality of the first ribs are positioned between adjacent ones of the plurality of the second ribs, and the plurality of the first ribs and the plurality of the second ribs are each formed such that a length of each said rib in the flow direction progressively increases as each said rib extends from adjacent the passage center to the first and second side edges of the wall surface and the height of the back surface of each said rib reduces as each said rib extends in the flow direction of the cooling medium and becomes zero at a rearward edge of each said rib, and wherein an upper surface of each of the cooling ribs is streamlined or similarly shaped.

2. The material having an internal cooling passage therein according to claim 1, wherein the material is a gas turbine blade.

3. A method of cooling a material having an internal cooling passage formed in the material, and with the internal cooling passage having a wall surface, the method comprising:

providing cooling ribs on the wall surface of the internal cooling passage;

allowing a cooling medium to flow along the wall surface;

providing a plurality of first ribs on the wall surface with each said first rib extending toward one side edge of the wall surface from adjacent an intermediate line extending between a first side edge and a second side edge of the internal cooling passage and in a downstream direction of a flow of the cooling medium;

providing a plurality of second ribs on the wall surface with each said second rib extending toward the second side edge of the wall surface from adjacent the intermediate line extending in the downstream direction of the flow of the cooling medium;

flowing the cooling medium in the flow direction through the internal cooling passage along the wall surface and the plurality of first and second ribs, alternatingly arranging the plurality of the first ribs and the plurality of the second ribs in the flow direction of the cooling medium;

providing the plurality of the first ribs and the plurality of the second ribs each having a cross section with a front surface providing the plurality of the first ribs and the plurality of the second ribs each having a back surface which is one of streamlined in the flow direction of the cooling medium and shaped similarly to a streamline of the cooling medium in the flow direction;

arranging the plurality of the first ribs and the plurality of the second ribs in a staggered array with respect to the flow direction of the cooling medium so that ones of the plurality of the first ribs are positioned between adjacent ones of the plurality of the second ribs;

forming the plurality of the first ribs and the plurality of the second ribs such that a length of each said rib in the flow direction is progressively increasing as each said rib extends from adjacent the passage center to the first and second side edges of the wall surface and the height of the back surface of each said rib is reducing as each said rib extends in the flow direction of the cooling medium and becomes zero at a rearward edge of each said rib; and wherein an upper surface of each of the cooling ribs is streamlined or similarly shaped.

* * * * *